US011457709B2

(12) United States Patent
Tseng et al.

(10) Patent No.: US 11,457,709 B2
(45) Date of Patent: Oct. 4, 2022

(54) ROTATION MECHANISM AND STORAGE DEVICE INCLUDING THEREOF

(71) Applicant: LUXSHARE-ICT CO., LTD., Taipei (TW)

(72) Inventors: Ching-Ping Tseng, Taipei (TW); Chen-Yu Chung, Taipei (TW); Ta-Yu Lin, Taipei (TW)

(73) Assignee: LUXSHARE-ICT CO., LTD., Taipei (TW)

( * ) Notice: Subject to any disclaimer, the term of this patent is extended or adjusted under 35 U.S.C. 154(b) by 0 days.

(21) Appl. No.: 17/390,092

(22) Filed: Jul. 30, 2021

(65) Prior Publication Data

US 2021/0353022 A1 Nov. 18, 2021

(30) Foreign Application Priority Data

Feb. 5, 2021 (TW) ..... 110201527

(51) Int. Cl.
*A45C 13/00* (2006.01)
*A45C 11/00* (2006.01)

(52) U.S. Cl.
CPC ..... *A45C 13/007* (2013.01); *A45C 11/00* (2013.01); *A45C 2011/001* (2013.01)

(58) Field of Classification Search
CPC . A45C 11/00; A45C 2011/001; A45C 13/005; A45C 13/007; B60R 7/06
USPC ..... 220/348, 833, 823, 827, 829, 810, 830
See application file for complete search history.

(56) References Cited

U.S. PATENT DOCUMENTS 4,456,145 A * 6/1984 Frank ..... H02G 3/088 439/142
6,530,498 B1 * 3/2003 Ovadia ..... A45C 13/007 220/829
7,527,166 B2 * 5/2009 Kondo ..... B60R 11/00 220/830
8,556,118 B2 * 10/2013 Hamaguchi ..... F16H 19/00 220/264
8,794,473 B2 * 8/2014 Kang ..... B60R 7/04 220/326
8,967,425 B2 * 3/2015 Lee ..... G03B 17/02 220/831
10,352,076 B2 * 7/2019 Selvakumar ..... B60N 2/793
(Continued)

FOREIGN PATENT DOCUMENTS

CN 209724958 U 12/2019
CN 113225638 * 8/2021

*Primary Examiner* — Rafael A Ortiz
(74) *Attorney, Agent, or Firm* — Birch, Stewart, Kolasch & Birch, LLP

(57) ABSTRACT

A rotation mechanism includes a base, a rotation plate, and an elastic element. The base has two base side walls opposite to each other, an accommodation space between the two base side walls, an abutting portion, and two pivot portions opposite to each other. The abutting portion is located at one end of the base side walls, and the pivot portions are respectively located at the other end of the base side walls. The rotation plate is pivotally connected to the base and between the pivot portions. The elastic element has a first pivot section, an elastic bending section, and a second pivot section that are sequentially connected to each other. The first pivot section is pivotally connected to the two base side walls, and the second pivot section is pivotally connected to one side of the rotation plate.

18 Claims, 7 Drawing Sheets

(56) References Cited

U.S. PATENT DOCUMENTS

| | | | | |
|---|---|---|---|---|
| 10,737,628 | B2 * | 8/2020 | Anderson | B60N 2/793 |
| 11,027,659 | B2 * | 6/2021 | Arendsen | B60R 7/046 |
| 11,185,974 | B2 * | 11/2021 | Omry | B25H 3/02 |
| 2004/0020935 | A1 * | 2/2004 | Inari | B60R 7/06 220/830 |
| 2007/0205208 | A1 * | 9/2007 | Ueda | H04N 5/2252 220/830 |

* cited by examiner

ROTATION MECHANISM AND STORAGE DEVICE INCLUDING THEREOF

CROSS-REFERENCE TO RELATED APPLICATION

This non-provisional application claims priority under 35 U.S.C. § 119(a) to Patent Application No. 110201527 filed in Taiwan, R.O.C. on Feb. 5, 2021, the entire contents of which are hereby incorporated by reference.

BACKGROUND

Technical Field

The present disclosure relates to a rotation mechanism and a storage device including thereof. In particular, to a rotation mechanism suitable for an earphone storage device and the earphone storage device including the rotation mechanism.

Related Art

In order to prevent a lid of an earphone storage box from automatically closing when the earphone storage box is placed on a desktop or alike, the earphone storage box known to the inventor(s) is provided with a spring inside for pushing the lid so as to keep the lid open. When the user wants to close the lid, the attraction between the magnets disposed on the lid and in the earphone storage box helps to close the lid and keeps the lid closed. However, since the magnetic attraction force will gradually weaken as time goes by, the elastic force of the spring will eventually be greater than the magnetic attraction force. Thus, the lid and the earphone storage box cannot be completely sealed with each other when the lid is closed.

SUMMARY

In order to solve the aforementioned problem(s), according to some embodiments, a rotation mechanism is provided. The rotation mechanism includes a base, a rotation plate, and an elastic element. The base has two base side walls opposite to each other, an accommodation space between the two base side walls, an abutting portion, and two pivot portions opposite to each other. The abutting portion is located at one of two ends of the base side walls, and the pivot portions are respectively located at the other end of the base side walls. The rotation plate pivotally is connected to the base and between the pivot portions. The elastic element has a first pivot section, an elastic bending section, and a second pivot section that are sequentially connected to each other. The first pivot section is pivotally connected to at least one of the two base side walls, and the second pivot section is pivotally connected to one side of the rotation plate. When the rotation plate is in a closed state, the elastic bending section abuts against the abutting portion, and when the elastic element drives the rotation plate to rotate around the pivot portions, the elastic bending section detaches from an abutting plane of the abutting portion, and the rotation plate is in an opened state.

In some embodiments, each of the two base side walls includes a first side wall and a second side wall perpendicular to each other. The abutting portion is located on the first side walls, and the two pivot portions are respectively located on the second side walls.

In some embodiments, the rotation plate has a pivot shaft, and the pivot portion has a pivot hole. The pivot shaft is inserted into the pivot hole, so that an included angle is capable of being formed between the rotation plate and the pivot portion.

In some embodiments, the rotation mechanism further includes a pin. The pin is connected to at least one of the two base side walls and located in the accommodation space, and wherein a number of the elastic element is two, and two ends of each of the two elastic elements are respectively pivotally connected to the pin and the rotation plate.

In some embodiments, the number of the pin is two, and the two pins are respectively connected to the two base side walls. Each of the two elastic elements is pivotally connected to the corresponding pin.

In some embodiments, the rotation mechanism further includes a spring pin. Each of the two elastic bending sections further includes a spring coil, and the spring pin passes through the two spring coils, so that the two elastic elements are capable of moving at the same time.

In some embodiments, the abutting portion further includes a leaning plane. When the rotation plate is in the closed state, the elastic bending section abuts against the leaning plane.

In some embodiments, the rotation plate further includes two connection portions opposite to each other and a rotation shaft. The connection portions and the rotation shaft are located at one side of the rotation plate, and the rotation shaft is located between the two connection portions. The second pivoting section is pivotally connected to the rotation shaft.

In some embodiments, the number of the rotation shaft is two, and each of the rotation shafts is connected to the corresponding connection portion.

In some embodiments, a storage device is provided. The storage device includes an accommodation body, an upper lid, and a rotation mechanism. The rotation mechanism includes a base, a rotation plate, and an elastic element. The base has two base side walls opposite to each other, an accommodation space between the two base side walls, an abutting portion, and two pivot portions opposite to each other. The abutting portion is located at one of two ends of the base side walls, and the pivot portions are respectively located at the other end of the base side walls. The rotation plate pivotally is connected to the base and between the pivot portions. The elastic element has a first pivot section, an elastic bending section, and a second pivot section that are sequentially connected to each other. The first pivot section is pivotally connected to at least one of the two base side walls, and the second pivot section is pivotally connected to one side of the rotation plate. When the rotation plate is in a closed state, the elastic bending section abuts against the abutting portion, and when the elastic element drives the rotation plate to rotate around the pivot portions, the elastic bending section detaches from the abutting portion, and the rotation plate is in an opened state. The base is connected to the accommodation body, and the rotation plate is connected to the upper lid, so that the upper lid is located at the accommodation body.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
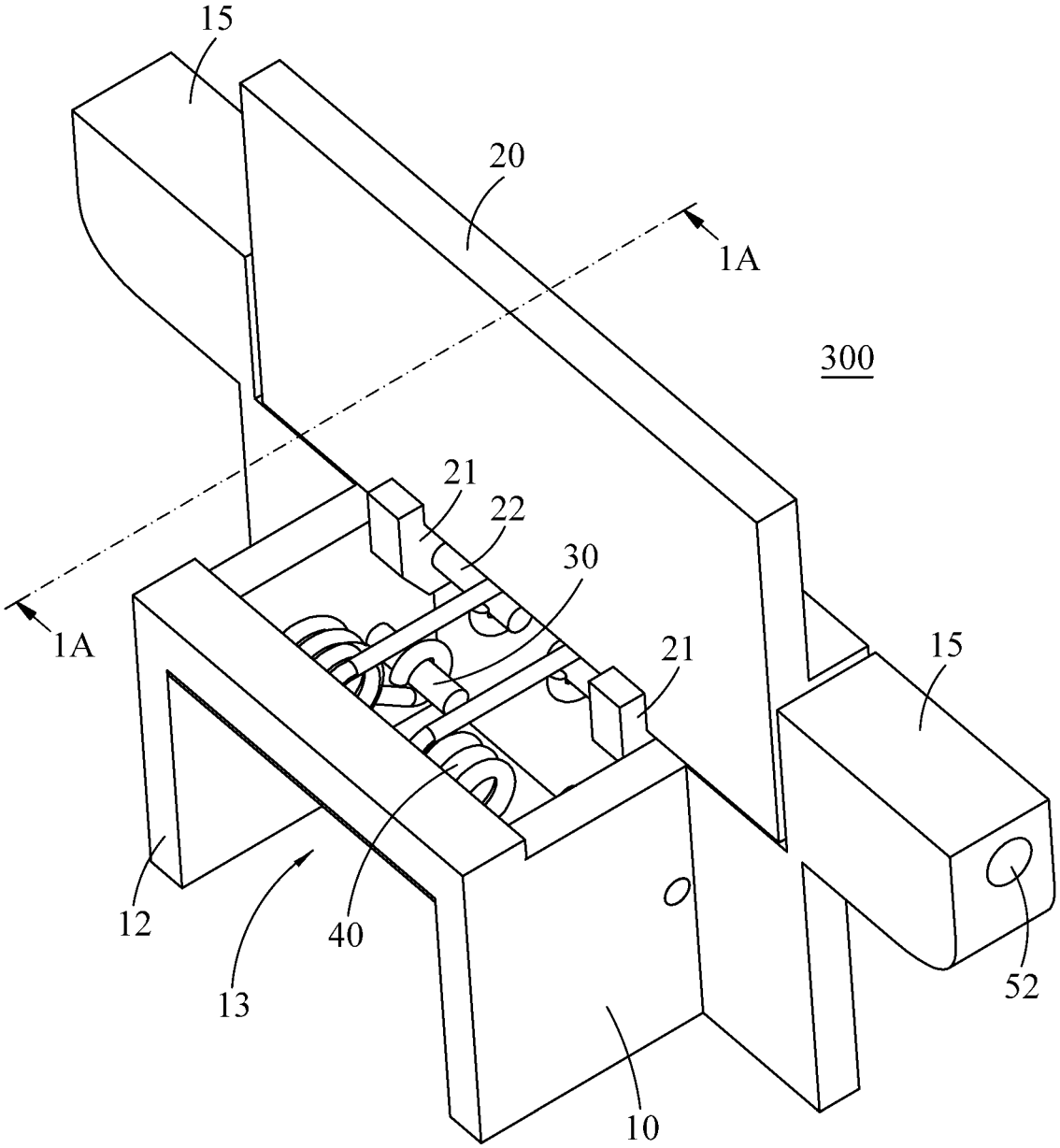
FIG. 1 illustrates a schematic perspective view of a rotation mechanism in a closed state according to some embodiments of the present disclosure.
Figure 2:
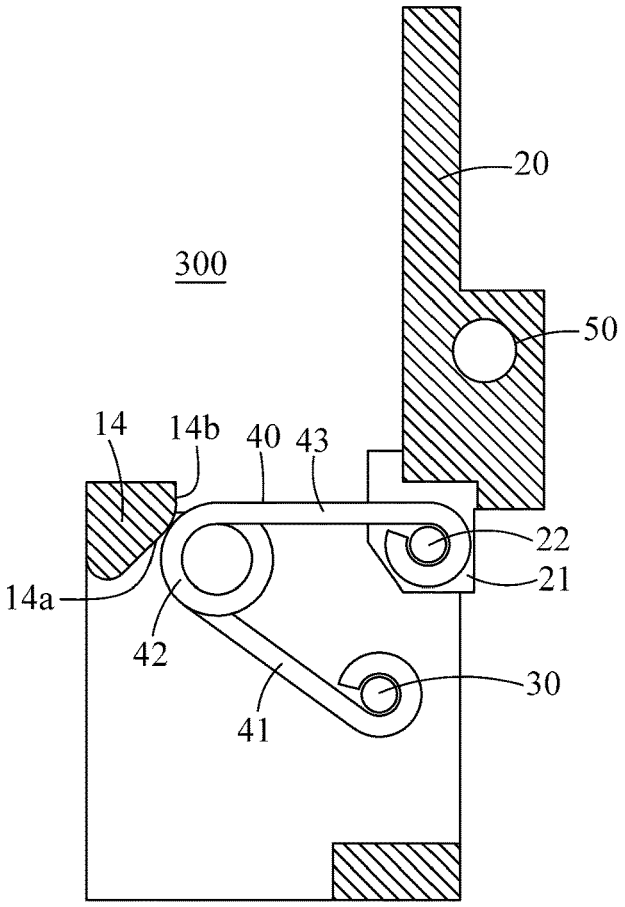
FIG. 2 illustrates a schematic cross-sectional view of the rotation mechanism shown in FIG. 1 taken along the line 1A-1A.
Figure 3:
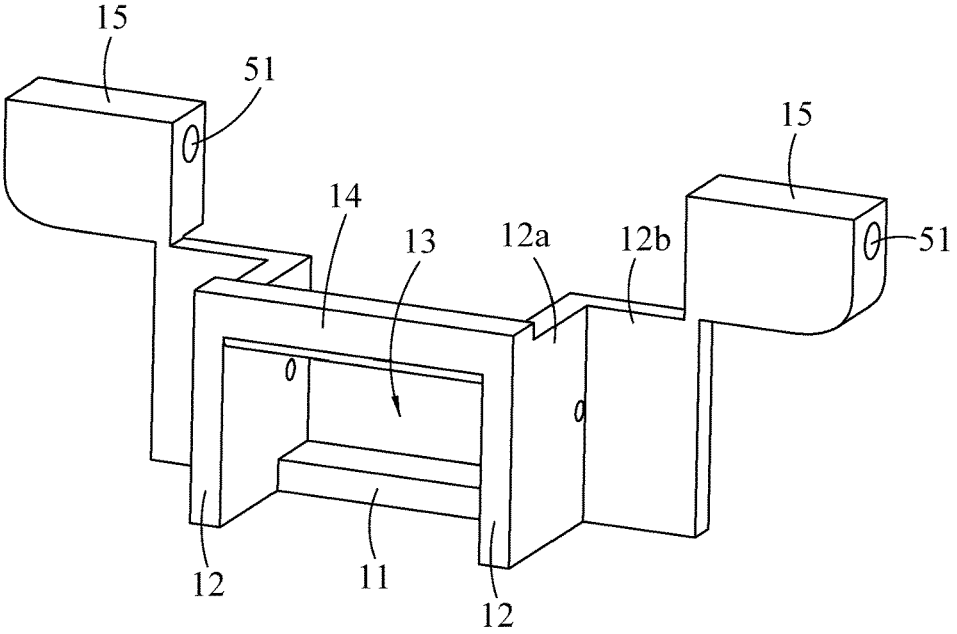
FIG. 3 illustrates a schematic perspective view of the base according to some embodiments of the present disclosure.

Please refer to FIG. 1 and FIG. 2. FIG. 1 illustrates a schematic perspective view of a rotation mechanism in a closed state according to some embodiments of the present disclosure. FIG. 2 illustrates a schematic cross-sectional view of the rotation mechanism shown in FIG. 1 taken along the line 1A-1A. FIG. 3 illustrates a schematic perspective view of the base 10 according to some embodiments of the present disclosure. The rotation mechanism includes a base 10, a rotation plate 20, and an elastic element 40.

The base 10 includes a bottom portion 11, two base side walls 12 opposite to each other, an accommodation space 13, an abutting portion 14, and two pivot portions 15 opposite to each other. The elastic element 40 is connected to at least one of the base side walls 12 and located in the accommodation space 13. As shown in FIG. 3, two ends of the bottom portion 11 are respectively connected to the two opposite base side walls 12, so that the accommodation space 13 is formed between the two opposite base side walls 12. The abutting portion 14 is located at one of two ends of the two opposite base side walls 12 relative to the bottom portion 11. More specifically, in this embodiment, the bottom portion 11 is located at the lower portion of the base side walls 12, and the abutting portion 14 is located at the upper portion of the base side walls 12. In this embodiment, the bottom portion 11 and the abutting portion 14 are on the diagonal line of the base side walls 12, and the bottom portion 11 and the abutting portion 14 are respectively located at the opposite corners along the diagonal line of the base side walls 12. Moreover, in this embodiment, the abutting portion 14 is located at one of two ends of the upper portion of the base side walls 12, and the pivot portions 15 are respectively located at the other end of the upper portion of the base side walls 12. In some embodiments, each of the base side walls 12 includes a first side wall 12*a* and a second side wall 12*b* perpendicular to each other. The two second side walls 12*b* respectively extend in a direction opposite to the accommodation space 13. The abutting portion 14 is connected to the two first side walls 12*a*, and the two pivot portions 15 are respectively connected to the two second side walls 12*b*.

Figure 4:
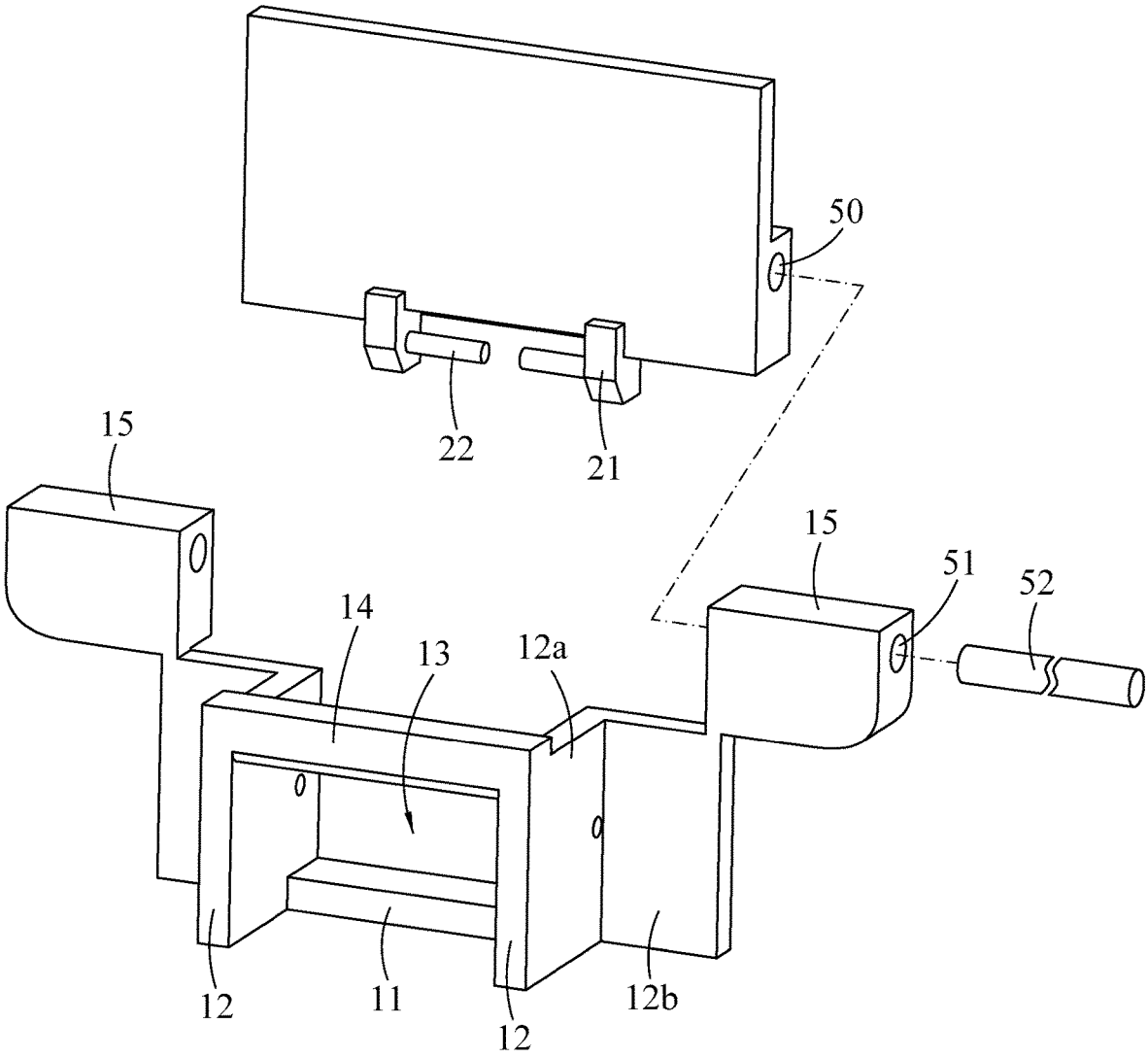
FIG. 4 illustrates a schematic exploded view (1) of the base and the rotation plate according to some embodiments of the present disclosure.

Please refer to FIG. 4. FIG. 4 illustrates a schematic exploded view (1) of the base 10 and the rotation plate 20 according to some embodiments of the present disclosure. The rotation plate 20 is a plate structure with a roughly rectangular shape. The rotation plate 20 is pivotally connected on the base 10 and is between the two pivot portions 15. In some embodiments, the rotation plate 20 has a pivot hole 50 and the pivot portion 15 has a pivot hole 51. By using an shaft 52 sequentially passing through the pivot hole 51 and pivot hole 50, the rotation plate 20 is pivotally connected to the base 10, so that rotation plate 20 can rotate around the pivot hole 50 and pivot hole 51. Accordingly, an included angle can be formed between the rotation plate 20 and the pivot portion 15 during the rotation of the rotation plate 20.

Figure 5:
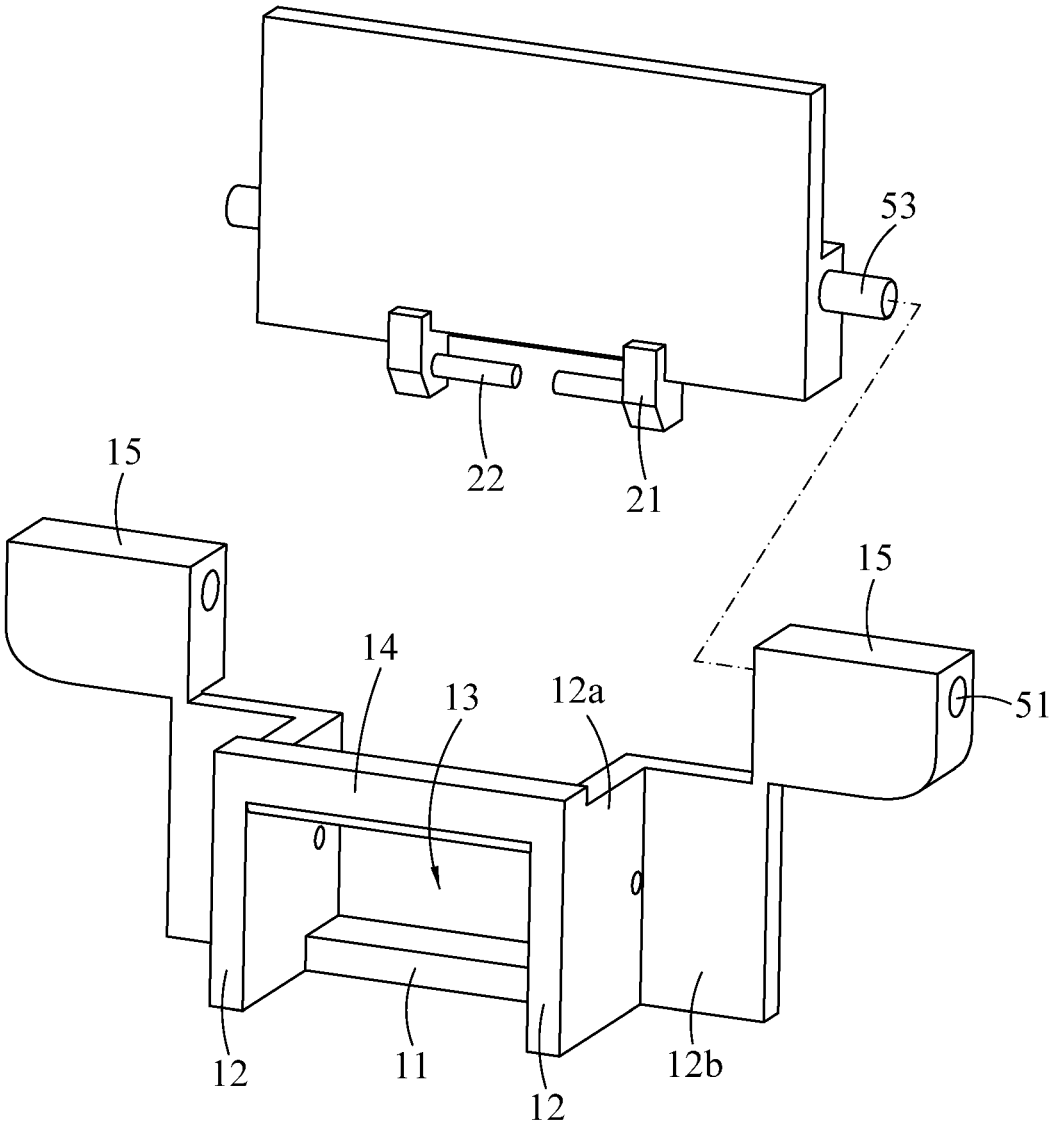
FIG. 5 illustrates a schematic exploded view (2) of the base and the rotation plate according to some other embodiments of the present disclosure.

Please refer to FIG. 5. FIG. 5 illustrates a schematic exploded view (2) of the base 10 and the rotation plate 20 according to some embodiments of the present disclosure. In some embodiments, the rotation plate 20 includes a pivot shaft 53, and the pivot portion 15 has a pivot hole 51. The pivot shaft 53 is inserted into the pivot hole 51, so that the rotation plate 20 is pivotally connected to the base 10, and thus the rotation plate 20 can rotate around the pivot hole 51. Accordingly, an included angle can be formed between the rotation plate 20 and the pivot portion 15 during the rotation of the rotation plate 20.

Please still refer to FIG. 1 and FIG. 2. The pin 30 is a rod structure with a roughly cylindrical shape, and the material of the pin 30 may be for example, but not limited to, metal or plastic. The pin 30 is connected to at least one of the two base side walls 12 and located in the accommodation space 13.

The elastic element 40 includes a first pivot section 41, an elastic bending section 42, and a second pivot section 43 that are sequentially connected to each other. In this embodiment, an included angle is formed between the first pivot section 41 and the second pivot section 43. The value of the included angle between the first pivoting section 41 and the second pivoting section 43 depends on the elastic force of the elastic bending section 42 as well as the force applied to the end of the first pivoting section 41 not connected to the elastic bending section 42 and the end of the second pivoting section 43 not connected to the elastic bending section 42. More specifically, in this embodiment, when the end of the first pivoting section 41 and the end of the second pivoting section 43 that are not connected to the elastic bending section 42 are applied with a force, the elastic element 40 will be compressed, so that the angle between the first pivot section 41 and the second pivot section 43 becomes smaller. On the other hand, when the force disappears, the elastic force of the elastic bending section 42 will make the included angle between the first pivoting section 41 and the second pivoting section 43 recover to the original value before the force is applied. In this embodiment, the elastic element 40 is a torsion spring, but is not limited thereto.

Figure 6:
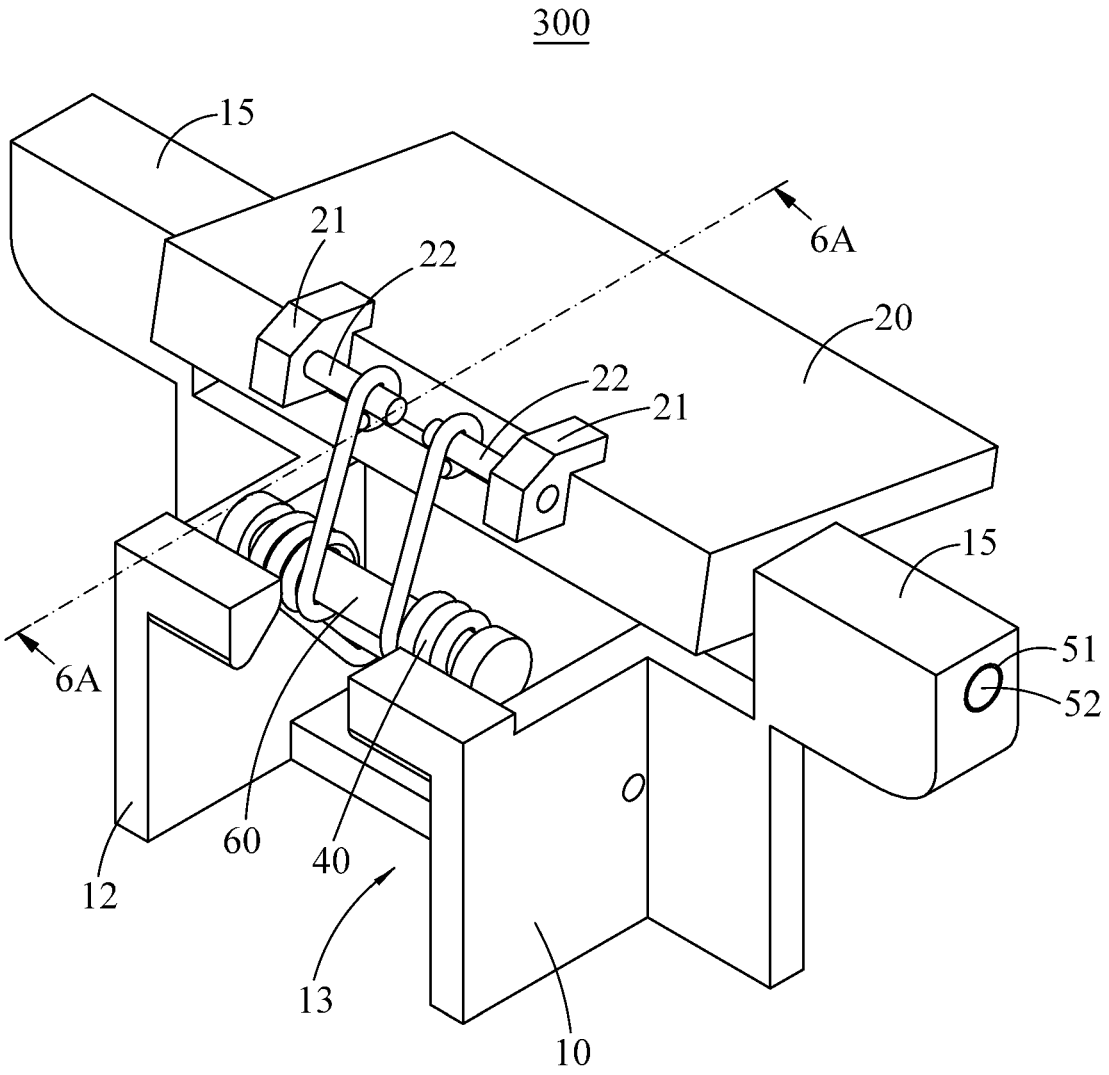
FIG. 6 illustrates a schematic perspective view of the rotation mechanism in an opened state according to some embodiments of the present disclosure.
Figure 7:
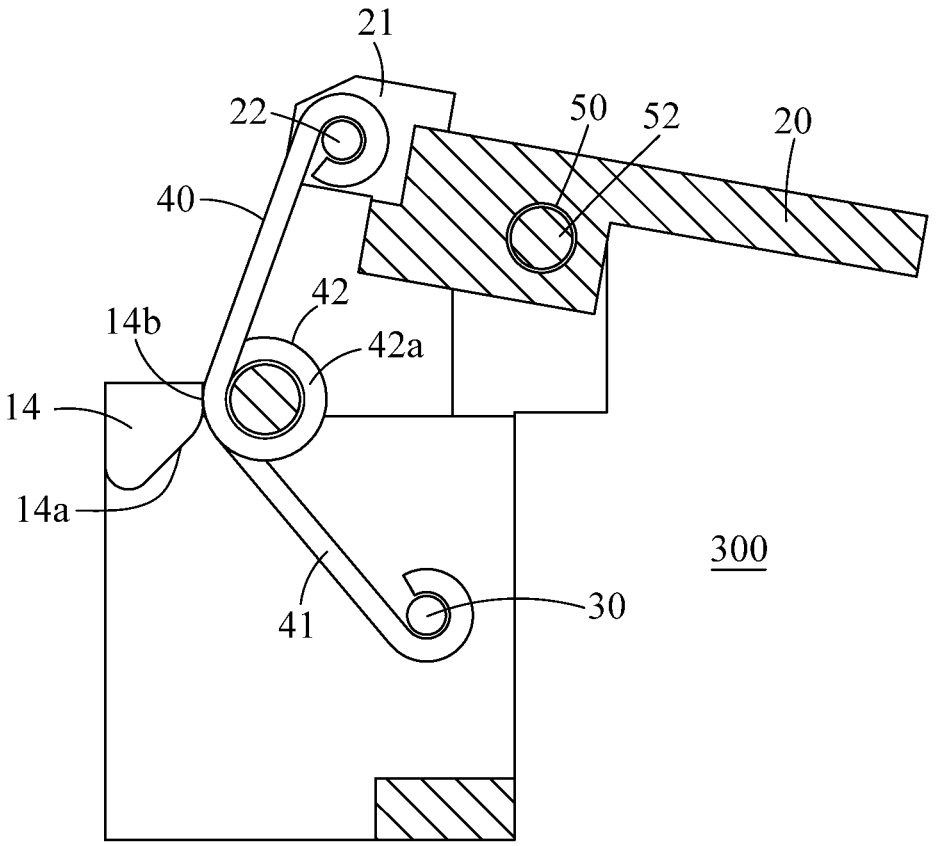
FIG. 7 illustrates a schematic cross-sectional view of the rotation mechanism shown in FIG. 6 taken along the line 6A-6A.

Please refer to FIG. 1, FIG. 2, FIG. 6, and FIG. 7. FIG. 6 illustrates a schematic perspective view of the rotation mechanism in an opened state according to some embodiments of the present disclosure. FIG. 7 illustrates a schematic cross-sectional view of the rotation mechanism shown in FIG. 6 taken along the line 6A-6A. The differences between the embodiment in FIG. 1 and FIG. 2 and the embodiment in FIG. 6 and FIG. 7 are the abutting portion 14 and the spring pin 60 (which will be discussed later). In this embodiment, the end of the first pivoting section 41 not connected to the elastic bending section 42 is pivotally connected to the pin 30, and the end of the second pivoting section 43 not connected to the elastic bending section 42 is pivotally connected to one side of the rotation plate 20. When the rotation plate is in the closed state, the elastic bending section 42 abuts against the abutting plane 14*a* of the abutting portion 14. When the rotation plate 20 is applied with an external force, the elastic element 40 drives the rotation plate 20 to rotate around the pivot portions 15, so that the elastic bending section 42 detaches from the abutting plane 14*a* of the abutting portion 14, and the rotation plate is in the opened state. More specifically, in this embodiment, when the rotation plate is in the closed state, the elastic bending section 42 abuts against the abutting plane 14*a* of the abutting portion 14, so that the elastic resilient force of the elastic element 40 can be reduced due to the abutting by the abutting portion 14.

When the rotation plate 20 is applied with an external force, the elastic bending section 42 will detach from the abutting plane 14*a* of the abutting portion 14. At the time, since the elastic element 40 is no longer abutted by the abutting plane 14*a* of the abutting portion 14, the elastic resilient force of the elastic element 40 can be released completely, so that the state of the rotation mechanism changes to the opened state. In this embodiment, the abutting portion 14 further includes a leaning plane 14*b* adjacent to the abutting plane 14*a*. When the state of the rotation mechanism changes from the closed state to the opened state, the elastic bending section 42 will detach from the abutting plane 14*a* and gradually move toward the leaning plane 14*b*. When the rotation mechanism is in the opened state, the elastic bending section 42 abuts against the leaning plane 14*b*. However, in some embodiments, the elastic bending section 42 does not abut against the leaning plane 14*b* when the rotation mechanism is in the opened state.

Please refer to FIG. 1 and FIG. 2. In this embodiment, the number of the elastic elements 40 is two. Two ends of each of the two elastic elements 40 are pivotally connected to the pin 30 and the rotation plate 20, respectively. Accordingly, the number of the pins 30 may also be two. Each of the pins 30 is connected to one base side wall 12, and each of the elastic elements 40 is pivotally connected to the corresponding pin 30. More specifically, in this embodiment, one elastic element 40 is pivotally connected to one pin 30. In some embodiments, the number of the elastic element 40 may be one. In some embodiments, the number of the pin 30 may be one, and two ends of the pin 30 are respectively connected to the two base side walls 12.

Please refer to FIG. 6 and FIG. 7. The rotation mechanism may further include a spring pin 60. In this embodiment, the number of the elastic elements 40 is two. The elastic bending section 42 includes a spring coil 42*a*, and the spring pin 60 passes through the two spring coils 42*a*. Therefore, since the two elastic elements 40 are connected with each other by the spring pin 60, when the two elastic elements 40 are applied with an external force, they will move at the same time. In some embodiments, the number of the abutting portions 14 may be two. Each of the abutting portions 14 corresponds to one elastic element 40.

Please refer to FIG. 1, FIG. 2, FIG. 6, and FIG. 7. The rotation plate 20 further includes two connection portions 21 opposite to each other and a rotation shaft 22. The connection portions 21 and the rotation shaft 22 are located at one side of the rotation plate adjacent to the elastic elements 40. The rotation shafts 22 are located between the two connection portions 21. One end of the second pivoting section 43 not connected to the elastic bending section 42 is pivotally connected to the rotation shaft 22. In some embodiments, the number of the rotation shafts 22 is two. Each of the rotation shafts 22 is connected to the corresponding connection portion 21.

Figure 8:
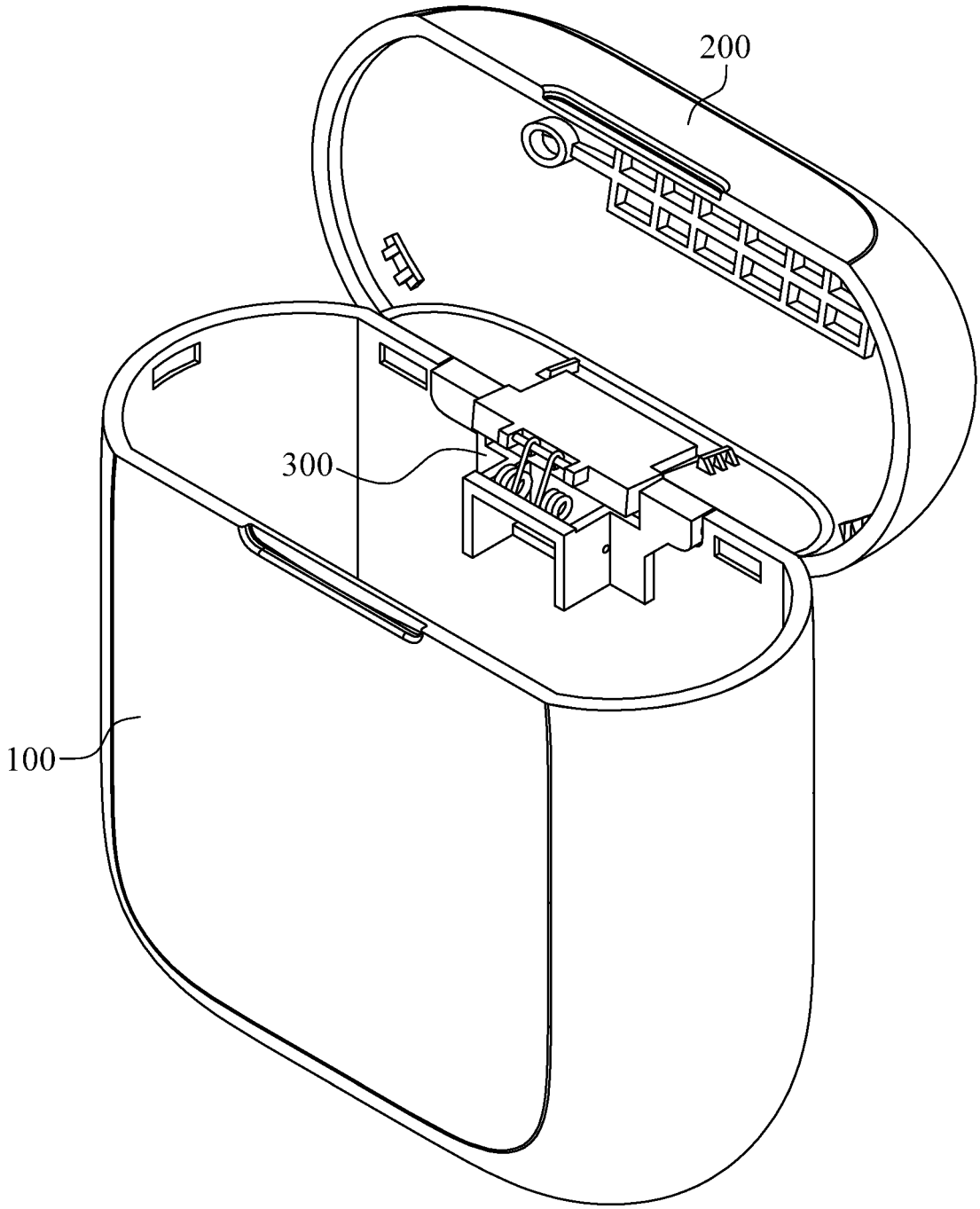
FIG. 8 illustrates a schematic perspective view of a storage device in an opened state according to some embodiments of the present disclosure.

Please refer to FIG. 8. FIG. 8 illustrates a schematic perspective view of a storage device in an opened state according to some embodiments of the present disclosure. The storage device includes an accommodation body 100, an upper lid 200, and a rotation mechanism 300. The rotation mechanism 300 includes a base 10, a rotation plate 20, a pin 30, and an elastic element 40. The structure of the rotation mechanism 300 is as mentioned above, and thus will not be described here again. Moreover, the base 10 of the rotation mechanism 300 is connected to the accommodation body 100, and the rotation plate 20 is connected to the upper lid 200. Thus, the upper lid 200 is located on the accommodation body 100. By the pivoting of the rotation plate 20, the rotation mechanism can be in the opened state, and the upper lid 200 will be driven by the rotation plate 20 to be opened. Correspondingly, by the pivoting of the rotation plate 20, the rotation mechanism can also be in the closed state, and the upper lid 200 will be driven by the rotation plate 20 to be closed. When the upper lid 200 is opened, the upper lid 200 is pushed by the elastic force of the elastic element 40 and thus the upper lid 200 is kept open. When the upper lid 200 is to be closed, the upper lid 200 is driven by an external force to rotate toward the accommodation body 100 to cover on the accommodation body 100. In this embodiment, the accommodation body 100 and the upper lid 200 may further respectively include a magnet, so that the upper lid 200 can be magnetically attracted to the accommodation body 100, which helps to keep the storage device closed. When the rotation mechanism 300 is in the closed state, since the elastic bending section 42 abuts against the abutting plane 14*a* of the abutting portion 14, the elastic resilient force of the elastic element 40 can be reduced due to the abutting by the abutting portion 14, thereby keeping the upper lid 200 closed more stably.

To sum up, according to one or some embodiments of the present disclosure, by having the abutting portion of the base in the rotation mechanism, the elastic element can abut against the abutting portion when the rotation mechanism is in the closed state. Thus, the elastic resilient force of the elastic element can be reduced due to the abutting of the abutting portion, by which the rotation mechanism can be kept in the closed state more stably. Therefore, according to one or some embodiments of the present disclosure, the rotation mechanism can solve the problem that the magnetic attraction force in the storage device will gradually weaken as time goes by, so that the elastic force of the spring will eventually be greater than the magnetic attraction force, which results that the lid and the earphone storage box cannot be completely sealed with each other when the lid is closed.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. A rotation mechanism, comprising:

a base having two base side walls opposite to each other, an accommodation space between the two base side walls, an abutting portion, and two pivot portions opposite to each other, wherein the abutting portion is located at one of two ends of the base side walls, and the pivot portions are respectively located at the other end of the base side walls;

a rotation plate pivotally connected to the base and between the pivot portions; and an elastic element having a first pivot section, an elastic bending section, and a second pivot section that are sequentially connected to each other, wherein the first pivot section is pivotally connected to at least one of the two base side walls, and the second pivot section is pivotally connected to one side of the rotation plate, wherein when the rotation plate is in a closed state, the elastic bending section abuts against the abutting portion, and when the elastic element drives the rotation plate to rotate around the pivot portions, the elastic bending section detaches from an abutting plane of the abutting portion, and the rotation plate is in an opened state.

2. The rotation mechanism according to claim 1, wherein each of the two base side walls comprises a first side wall and a second side wall perpendicular to each other, and wherein the abutting portion is located on the first side walls, and the two pivot portions are respectively located on the second side walls.

3. The rotation mechanism according to claim 1, wherein the rotation plate has a pivot shaft, and the pivot portion has a pivot hole, and wherein the pivot shaft is inserted into the pivot hole, so that an included angle is capable of being formed between the rotation plate and the pivot portion.

4. The rotation mechanism according to claim 1, further comprising a pin, wherein the pin is connected to at least one of the two base side walls and located in the accommodation space, and wherein a number of the elastic element is two, and two ends of each of the two elastic elements are respectively pivotally connected to the pin and the rotation plate.

5. The rotation mechanism according to claim 4, wherein a number of the pin is two, and the two pins are respectively connected to the two base side walls, and wherein each of the two elastic elements is pivotally connected to the corresponding pin.

6. The rotation mechanism according to claim 4, further comprising a spring pin, wherein each of the two elastic bending sections further comprises a spring coil, and wherein the spring pin passes through the two spring coils, so that the two elastic elements are capable of moving at the same time.

7. The rotation mechanism according to claim 1, wherein the abutting portion further comprises a leaning plane, and wherein when the rotation plate is in the closed state, the elastic bending section abuts against the leaning plane.

8. The rotation mechanism according to claim 1, wherein the rotation plate further comprises two connection portions opposite to each other and a rotation shaft, wherein the connection portions and the rotation shaft are located at one side of the rotation plate, and wherein the rotation shaft is located between the two connection portions, and the second pivoting section is pivotally connected to the rotation shaft.

9. The rotation mechanism according to claim 8, wherein the number of the rotation shaft is two, and each of the rotation shafts is connected to the corresponding connection portion.

10. A storage device, comprising:

an accommodation body;

an upper lid connected to the accommodation body; and a rotation mechanism, comprising:

a base having two base side walls opposite to each other, an accommodation space between the two base side walls, an abutting portion, and two pivot portions opposite to each other, wherein the abutting portion is located at one of two ends of the base side walls, and the pivot portions are respectively located at the other end of the base side walls;

a rotation plate pivotally connected to the base and between the pivot portions; and an elastic element having a first pivot section, an elastic bending section, and a second pivot section that are sequentially connected to each other, wherein the first pivot section is pivotally connected to at least one of the two base side walls, and the second pivot section is pivotally connected to one side of the rotation plate, wherein when the rotation plate is in a closed state, the elastic bending section abuts against the abutting portion, and when the elastic element drives the rotation plate to rotate around the pivot portions, the elastic bending section detaches from an abutting plane of the abutting portion, and the rotation plate is in an opened state;

wherein the base is connected to the accommodation body, and the rotation plate is connected to the upper lid, so that the upper lid is located at the accommodation body.

11. The storage device according to claim 10, wherein each of the two base side walls comprises a first side wall and a second side wall perpendicular to each other, and wherein the abutting portion is located on the first side walls, and the two pivot portions are respectively located on the second side walls.

12. The storage device according to claim 10, wherein the rotation plate has a pivot shaft, and the pivot portion has a pivot hole, and wherein the pivot shaft is inserted into the pivot hole, so that an included angle is capable of being formed between the rotation plate and the pivot portion.

13. The storage device according to claim 10, further comprising a pin, wherein the pin is connected to at least one of the two base side walls and located in the accommodation space, and wherein a number of the elastic element is two, and two ends of each of the two elastic elements are respectively pivotally connected to the pin and the rotation plate.

14. The storage device according to claim 13, wherein a number of the pin is two, and the two pins are respectively connected to the two base side walls, and wherein each of the two elastic elements is pivotally connected to the corresponding pin.

15. The storage device according to claim 13, further comprising a spring pin, wherein each of the two elastic bending sections further comprises a spring coil, and wherein the spring pin passes through the two spring coils, so that the two elastic elements are capable of moving at the same time.

16. The storage device according to claim 10, wherein the abutting portion further comprises a leaning plane, and wherein when the rotation plate is in the closed state, the elastic bending section abuts against the leaning plane.

17. The storage device according to claim 10, wherein the rotation plate further comprises two connection portions opposite to each other and a rotation shaft, wherein the connection portions and the rotation shaft are located at one side of the rotation plate, and wherein the rotation shaft is located between the two connection portions, and the second pivoting section is pivotally connected to the rotation shaft.

18. The storage device according to claim 17, wherein the number of the rotation shaft is two, and each of the rotation shafts is connected to the corresponding connection portion.

* * * * *